United States Patent [19]

Rochat

[11] 4,060,977

[45] Dec. 6, 1977

[54] TIMEPIECE

[75] Inventor: Daniel Rochat, Neuchatel, Switzerland

[73] Assignee: Ebauches S.A., Switzerland

[21] Appl. No.: 679,473

[22] Filed: Apr. 22, 1976

[30] Foreign Application Priority Data

May 1, 1975 Switzerland ..... 5611/75

[51] Int. Cl.[2] ..... G04B 27/08

[52] U.S. Cl. ..... 58/85.5; 58/4 R; 58/5; 58/58

[58] Field of Search ..... 58/58, 85.5, 42.5, 4 R, 58/5, 125 B, 126 A

[56] References Cited

U.S. PATENT DOCUMENTS

| | | | |
|---|---|---|---|
| 3,704,583 | 12/1972 | Dome | 58/58 |
| 3,710,567 | 1/1973 | Cleusix | 58/58 |
| 3,738,097 | 6/1973 | Vuilleumier | 58/58 X |
| 3,871,169 | 3/1975 | Schwaar et al. | 58/85.5 X |

*Primary Examiner*—Ulysses Weldon

*Attorney, Agent, or Firm*—St. Onge, Mayers, Steward & Reens

[57] ABSTRACT

A date correcting mechanism for a watch or other timepiece having a crown-ring indicator for the date, in which the indicator is moved once a day by a rotatable driving disc which carries pins meshing with slots in the crown-ring. The correcting mechanism includes means for connecting the watch stem to the driving disc for manually setting the crown-ring indicator. A cam-plate which is driven by the watch movement is mounted for movement out of its operative position in which it cooperates with the pins on the driving disc to rotate the disc step-by-step and also to prevent it from rotating between steps in order to avoid inadvertent movement of the indicator. By mounting the cam-plate in this manner, it can be moved to an inoperative position, so that the pins on the driving disc can pass when the driving disc is actuated by the watch stem.

14 Claims, 5 Drawing Figures

TIMEPIECE

BACKGROUND OF THE INVENTION

The present invention relates to a timepiece comprising a control mechanism having a rotatable stem able to occupy several axial positions, in each of which it effects a different operation, and which comprises a calendar mechanism having a crown-ring indicator with radial slots with which two pins cooperate. The pins are carried by a driving disc on which they are diametrically opposed at a distance from each other corresponding to the distance separating the openings to the said slots, the driving disc being rotatably driven, step-by-step, at a speed of one step per 24 hours. A driving member, which is itself driven by the movement of the timepiece at a speed of one revolution per 24 hours, drives the driving disc so that at each step of the said disc one of its pins drives the crown-ring through one step. During each step the pin travels in a reciprocating movement into and out of one of the slots of this crown-ring. At each of the successive rest positions, the two pins of the driving disc simultaneously engage within the openings to two of the said slots, so as to lock the crown-ring.

Timepieces such as those hereabove disclosed are known. However, they have the drawback that the setting of the date indicator, for instance at the end of those months having 30 days, must be effected by the control stem when it occupies its time-setting position. This requires movement of the entire driving mechanism for the hour and minute indicators in order to set the date indicator. Such a correction is obviously slow and fastidious for the user.

The object of the present invention is to provide such a timepiece with a correcting mechanism for the data indicator which acts directly on the indicator for permitting rapid correction.

To this end, the timepiece according to the invention is provided with an improved correcting mechanism, operable by the control stem when it occupies one of its axial positions, this correcting mechanism including means for connecting the control stem and driving disc when the control stem is in such axial position, the driving member for this disc being arranged in such a way as to be able to occupy an inoperative position in which it releases the disc so that the disc can then be operated by the correcting mechanism.

The drawing, in which only the elements necessary to the understanding of the invention have been represented, shows two embodiments of the invention and a modification.

Figure 1:
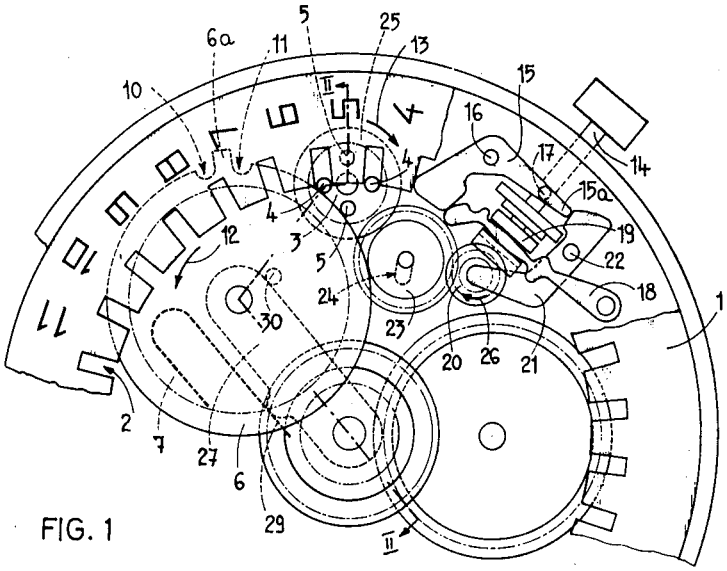
FIG. 1 is a plan view of a calendar mechanism for a watch in which the invention is embodied.
Figure 2:
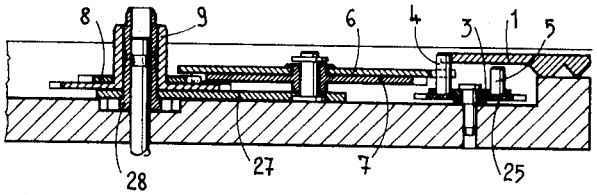
FIG. 2 is a sectional view along line II—II of FIG. 1.

The watch shown in FIGS. 1 and 2 comprises a calendar mechanism including a crown-ring 1 indicating the day of the month. Crown-ring 1 is provided with radial slots 2 for driving engagement by a driving disc 3 carrying diametrically opposed pins 4 separated one from the other by a distance corresponding to the distance separating the openings to the slots 2. The disc 3 also carries two pins 5, which are shorter than the pins 4, so as to be able to pass under the crown-ring 1. The distance between pins 5 is the same as the distance between the pins 4, pins 5 being located on a diameter of the disc 3 which is perpendicular to the diameter passing through the axes of pins 4.

Disc 3 is driven by a cam-plate 6, which is rotated at the rate of one revolution per 24 hours by a wheel 7 rigid therewith which meshes with the wheel 8 rigid with the hours wheel 9, (FIG. 2). Cam-plate 6 is provided with a radial finger 6*a* and with two notches 10 and 11 situated on both sides of the finger 6*a*. At each revolution of the plate 6 as it rotates in the direction of the arrow 12 (FIG. 1), the finger 6*a* cooperates with one of the pins 5 and rotates the disc 3 (in the direction of the arrow 13) through half a revolution, the pin 5 on which the finger is acting engaging the notch 10, rotation of the disc being achieved by the action of the plate on the pin 4 following the pin 5 with which the finger 6*a* has cooperated and which engages the notch 11 of the cam-plate.

It is to be noted that, at rest, the disc 3 is held in place by engagement of the two adjacent drive pins 4 and 5 with the circular portion of cam-plate 6. At the same time both pins 4 are simultaneously engaged within the openings to two of the slots 2 in the crown-ring 1, so that the crown-ring indicator is locked in the position to which it is indexed.

The watch represented includes a control mechanism having a rotatable stem, designated at 14, capable of occupying three axial operating positions, the first or innermost being the normal operating position, which in the case of a mechanical spring watch is for winding and in the case of an electrical watch is the neutral position. In the second or intermediate position, which is represented in the drawing, the control stem 14 operates a correcting mechanism of the date indicator, hereafter disclosed. The third or outer-most position of stem 14 is for setting of the time.

The control mechanism also includes a trigger-piece 15, which is pivoted at 16 on the frame of the movement and carries a pin 17 engaging a groove (not represented) in the stem 14. Trigger-piece 15 operates a lever 18 for controlling a pinion 19 mounted at the inner end of control stem 14 so that it can slide axially thereof.

The correcting mechanism for the crown-ring indicator 1 consists of 1) a pinion 20 carried by a lever 21 articulated at 22 on the frame of the movement for actuation by a finger 15*a* of the trigger-piece, 2) a sliding pinion 23 meshing with the pinion 20, the pivot shaft of which is movably mounted in an elongated aperture 24 of the frame of the movement and 3) a pinion 25 secured to the driving disc 3.

In the intermediate position of the control stem 14 as represented in the drawing, the lever 21 occupies a position such that pinion 20 meshes with the sliding pinion 19. Consequently, when the control stem is driven in a direction such that it rotates the pinion 20 in the direction of the arrow 26 (FIG. 1), the sliding pinion 23 occupies the position represented in the drawing in which it meshes with the pinion 25, so that disc 3 is driven in its normal direction, that is to say in the direction of the arrow 13.

So that the cam-plate 6 does not prevent the rotation of the disc 3 when it is desired to set the date indicator manually, plate 6 is mounted on a lever 27 which is pivoted on the frame of the movement around the cannon-pinion, designated by 28. A return spring 29 urges lever 27 against an abutment pin 30, into a position corresponding to the operating position of the plate 6. Consequently, when the disc 3 is driven manually by the correcting mechanism, the action of its pins 4 and 5 produces displacements of the lever 27 against the action of its return spring 29, intermittently moving cam-plate 6 to an inoperative position which permits the pins on disc 3 to pass.

Owing to this arrangement, the crown-ring 1 can be displaced rapidly, thereby permitting rapid correction of the date, for instance at the end of those months having 30 days.

The connection between the disc 3 and its correction pinion 25 is desirably a friction one so as to prevent any danger of damaging the mechanism in case the correction is effected at the very moment when the finger 6a of the plate 6 is meshing with the pins of the disc.

It is to be noted that, when the control stem 14 is operated so as to drive the pinion 20 in the direction opposite to that indicated by the arrow 26, the sliding pinion 23 is moved so that its axis occupies the other end of the elongated aperture 24. In this position, sliding pinion 23 becomes disengaged from the pinion 25 and the disc 3 is thus not driven. Owing to this one-way coupling arrangement, correction can be effected only in the direction corresponding to the normal running direction, thereby preventing the pins 4 and 5 from acting on cam-plate 6 in a direction counter to the direction in which it is driven by the watch movement.

It is also to be noted that after each displacement of the date indicator by means of the correcting mechanism, the indicator automatically occupies a precise position. This is due to the action of the return spring 29 of the lever 27, which moves the lever into engagement with a stationary abutment positioned so that cam-plate 6 is located with its circular portion engaging the two adjacent ones of pins 4 and 5 when disc 3 is in the right position for both pins 4 to be engaged within the openings to two of the slots 2 in the crown-ring 1.

Figure 3:
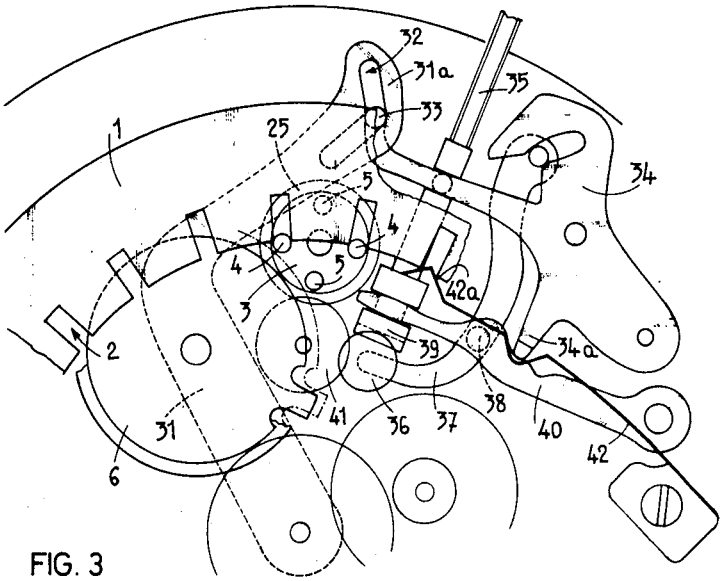
FIGS. 3 and 4 are plan views of a second embodiment of the invention showing the control mechanism in two different operating positions.
Figure 4:
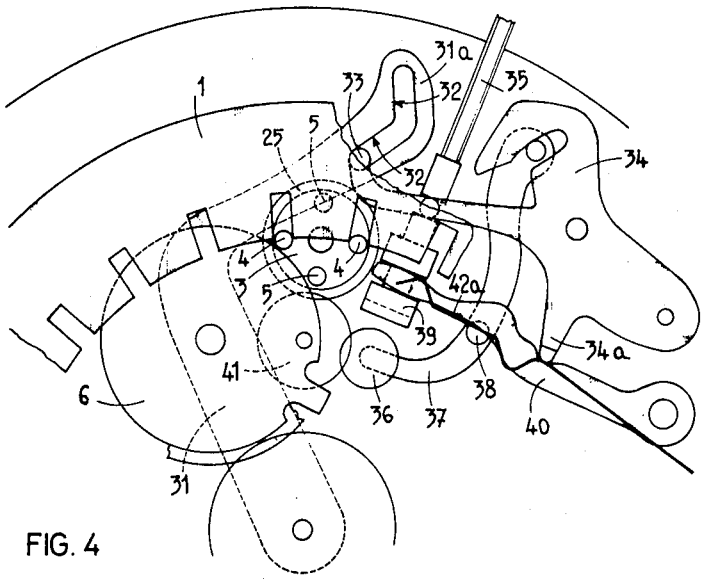

The embodiment of FIGS. 3 and 4 differs from that of FIGS. 1 and 2 in the fact that the lever 31 carrying the cam-plate 6 is not subjected to the action of a return spring but is provided with an elongation 31a, in which is provided a V-shaped aperture 32. A pin 33 carried by the trigger-piece 34 extends into aperture 32 for cooperation therewith. When the control stem 35 occupies its intermediate position which is represented in FIG. 3, the pin 33 of the trigger-piece 34 is situated at the apex of the V-shaped aperture 32. In this position, the lever 31 occupies a position in which the cam-plate 6 is rendered inoperative, due to the fact that its periphery is disposed outside the path of movement of pins 4 and 5, thereby allowing disc 3 to be freely driven by the correcting mechanism. The correcting mechanism in this case includes a pinion 36, corresponding to the pinion 20 of the first embodiment. Pinion 36 is carried by a lever 37 that is pivoted about a pin 38 mounted on the frame of the movement and is subjected to the action of the trigger-piece 34. A sliding pinion 39, corresponding to pinion 19 of FIG. 1, is subjected to the action of a control lever 40, which in turn is acted on by a finger 34a on trigger-piece 34 when the latter is pivoted by axial movement of the control stem 35.

The correcting mechanism of the present embodiment also includes an intermediate pinion 41, corresponding to the sliding pinion 23 of the first embodiment, but which in this case does not slide and therefore continuously meshes with the pinion 25 of the driving disc 3. It will be noted that when the correcting mechanism is engaged, the pins 4 and 5 of driving disc 3 do not come in contact with cam-plate 6. It is therefore not necessary in this case for correction of the date indicator to be made in only one direction.

Also provided in the embodiment of FIGS. 3 and 4 is a blade-spring 42, which is secured to the frame of the movement and which constitutes a jumper. To this end, jumper-spring 42 is provided with a V-shaped bent portion 42a which cooperates with each of the slots 2 of the crown-ring 1 for ensuring that the date indicator returns to very precise positions of rest each time it is manually set by the correcting mechanism. However, so that this jumper does not exert a useless force on the crown-ring 1 which would have to be overcome by the movement when the date indicator is driven by the cam-plate 6, jumper-spring 42 is subjected to the action of the finger 34a of the trigger-piece 34 which controls the lever 40, so that, when the stem 35 occupies either its inner-most or its outer-most position, this jumper is held out of engagement with crown-ring 1. As illustrated in FIG. 4, in which the stem 35 is shown pushing inward to its innermost position, jumper-spring 42 is held away from crown-ring 1, as is likewise true when trigger-piece 34 is pivoted to its other extreme when stem 35 is pulled all the way out.

It is to be noted that jumper-spring 42 is not absolutely necessary since, when the stem 35 is brought back into one or the other of its two pulled and pushed positions, the lever 31 is pivoted clockwise from the position shown in FIG. 3 to the position shown in FIG. 4, thereby moving the cam-plate 6 into contact with the two adjacent pins 4 and 5 of the driving disc 3 and in this way ensuring the accuracy of the position of the date indicator. However, when the correcting mechanism is used to change the date, jumper-spring 42 prevents the crown-ring 1 from accidentally occupying a position in which the pins 4 do not correctly engage the two slots 2 of the crown-ring 1. Such a condition would result in the date indicator displaying an incorrect date, because the date indicia would not be perfectly centered in the window of the dial through which the dates are visible.

In FIG. 4 which shows the control mechanism of the watch of FIG. 3 with stem 35 in the pushed or normal position, pin 33 of the trigger-piece 34 is situated at the end of one of the branches of the V-shaped aperture 32 in the arm 31a of the lever 31, the plate 6 then occupying its normal working position.

Simultaneously, the lever 37 carrying the pinion 36 of the gearing of the correction mechanism is separated from the sliding pinion 39 so that the operation of the stem 35 can not operate the correcting mechanism.

It is to be noted that when the stem 35 is pulled to its outermost or time-setting position, pin 33 is situated at the upper end of the second branch of the V-shaped aperture 32 in the arm 31a of the lever 31 and that lever 31 then occupies the same position it occupies when the stem is at its innermost position as shown in FIG. 4.

Figure 5:
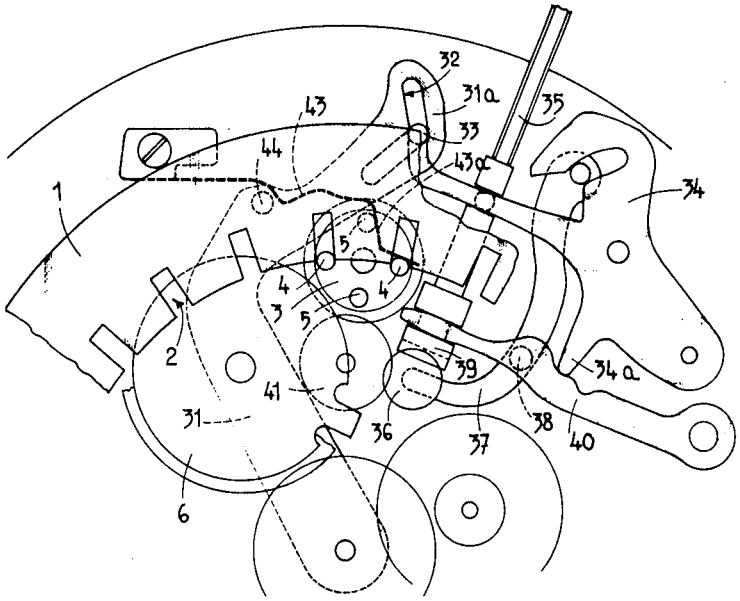
FIG. 5 is a plan view of a modification of the arrangement illustrated in FIGS. 4 and 5.

The modification of FIG. 5 differs from the second embodiment in the fact that the jumper consists of a blade 43 which does not cooperate with the slots 2 of the crown-ring 1 but is provided with a V-shaped portion 43a cooperating with the pins 4 and 5 of the driving disc 3. Moreover, this jumper 43 is not controlled by the trigger-piece, as in the embodiment of FIGS. 3 and 4, but by the lever 31 which is provided with a pin 44 acting on the said jumper in order to disengage it from pins 4 and 5 when the control stem 35 is moved either to its innermost or outermost positions.

What I claim is:

1. In a timepiece having a control mechanism including a rotatable control stem with several axial positions, at each of which it effects a different operation, a calendar mechanism including a crown-ring indicator having circumferentially spaced radial slots, a driving disc having a pair of diametrically opposed drive pins spaced from each other a distance corresponding to the distance separating the openings to said slots, a driving member rotatably driven at the rate of one revolution per 24 hour period and having means for driving said driving disc step-by-step at the rate of one step per 24 hour period, said driving disc and crown-ring indicator being disposed such that said drive pins cooperate with said radial slots so that during each step of said driving disc one of said pins drives said crown-ring indicator through one step while traveling into and out of one of said slots, said drive pins during each successive rest position of said driving disc being disposed in locking engagement within the openings to two of said slots, an improved correcting mechanism for setting said crown-ring indicator comprising means for connecting said control stem and driving disc when said control stem is in one of its axial positions, and means for mounting said driving member for movement to an inoperative position with respect to said driving disc for releasing said driving disc with respect thereto so that said driving disc can be operated by said correcting mechanism.

2. An improved correcting mechanism as defined in claim 1, in which said driving member comprises a cam-plate driven by the movement of the timepiece, said driving disc having a second pair of drive pins which are shorter than said first-mentioned drive pins so that they pass under said crown-ring indicator, said second pair of drive pins being situated on a diameter of said driving disc that is perpendicular to the diameter through the axes of said first pins, said cam-plate having a radial finger for driving said driving disc and a pair of notches, one disposed on each side of said finger, said finger and notches being engageable with said drive pins on each revolution of said cam-plate, said cam-plate also having a circular surface for engagement by two of said pins simultaneously for locking said driving disc in its said rest position, said means for mounting said driving member including a pivoted lever element on which said cam-plate is mounted for movement to said inoperative position.

3. An improved correcting mechanism as defined in claim 2, which further includes a spring for urging said lever against a stationary abutment disposed for positioning said cam-plate in an operative position, displacement of said cam-plate into its inoperative position being produced by said drive pins when said driving disc is driven by said correcting mechanism.

4. An improved correcting mechanism as defined in claim 3, wherein said correcting means comprises a one-way coupling interposed between said control stem and said driving disc such that said driving disc can be driven by said control stem only in one direction.

5. An improved correcting mechanism as defined in claim 4, wherein said one-way coupling comprises a sliding pinion movable into an operative position when said control stem is rotated in one direction for connecting said control stem and said driving disc, and into an inoperative position when said control stem is rotated in the opposite direction, in which inoperative position said control stem and driving disc are disconnected.

6. An improved correcting mechanism as defined in claim 2, in which said control mechanism includes a trigger-piece element movable into different positions by said control stem upon movement of said stem axially, said trigger-piece element being connected to said lever element such that in said one axial position of said control stem said cam-plate is disposed in said inoperative position.

7. An improved correcting mechanism as defined in claim 6, in which said control stem is capable of occupying three axial positions; namely, a first position in which it is normally located during operation of said timepiece, a second or intermediate position in which it is connected to said driving disc for correcting said crown-ring indicator, and a third position for setting the time; wherein one of said trigger piece and lever elements is provided with a V-shaped aperture and the other of said trigger-piece and lever elements having a protrusion engaged within said aperture, said last named elements and aperture being arranged such that when said control stem is in said first and third positions and protrusion is situated respectively at the outer ends of the two branches constituting said V-shaped aperture, thereby moving said cam-plate on said lever element to its operative position; and when said control stem is in said intermediate position said protrusion is situated at the apex of said V-shaped aperture, thereby moving said cam-plate to said inoperative position.

8. An improved correcting mechanism as defined in claim 6, which further comprises a jumper mounted for cooperation with an element of said calendar mechanism so as to ensure accurate positioning of said crown-ring indicator when said indicator is changed by said correcting mechanism.

9. An improved mechanism as defined in claim 8, which further includes means for disengaging said jumper from said calendar-mechanism element when said cam-plate is disposed in said operative position.

10. An improved correcting mechanism as defined in claim 9, wherein said means for disengaging said jumper comprises a pin on said lever element disposed for engagement with said jumper for moving said jumper out of engagement with said calendar-mechanism element when said cam-plate is disposed in its operative position.

11. An improved correcting mechanism as defined in claim 9, wherein said means for disengaging said jumper comprises a finger portion of said trigger-piece element movable into engagement with said jumper for moving said jumper out of engagement with said calendar-mechanism element when said cam-plate is disposed in said operative position.

12. An improved mechanism as defined in claim 8, wherein said calendar-mechanism element comprises said driving disc, said jumper being disposed for engagement with said drive pins.

13. An improved correcting mechanism as defined in claim 8, wherein said calendar-mechanism element comprises said crown-ring indicator, said jumper being disposed for engagement with said radial slots.

14. An improved correcting mechanism as defined in claim 6, wherein said means for connecting said control stem and driving disc comprises a first pinion carried by said control stem and a second pinion carried by a pinion lever for driving engagement with said first pinion, said first pinion being slidably mounted on said control stem for movement axially thereof, means interconnecting said first pinion and said trigger-piece element for moving said first pinion upon movement of said trigger-piece element and said pinion lever being cooperatively engaged by said trigger-piece element, such that said pinions are in meshing engagement only when said control stem is disposed in a said one axial position.

* * * * *